US008538048B2

(12) United States Patent
Kim et al.

(10) Patent No.: US 8,538,048 B2
(45) Date of Patent: Sep. 17, 2013

(54) METHOD AND APPARATUS FOR COMPENSATING FOR NEAR-FIELD EFFECT IN SPEAKER ARRAY SYSTEM

(75) Inventors: Jung-ho Kim, Yongin-si (KR); Seng-chul Ko, Seoul (KR); Young-tae Kim, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1023 days.

(21) Appl. No.: 12/076,432

(22) Filed: Mar. 18, 2008

(65) Prior Publication Data

US 2009/0097666 A1 Apr. 16, 2009

(30) Foreign Application Priority Data

Oct. 15, 2007 (KR) ..... 10-2007-0103733

(51) Int. Cl.
*H04R 5/00* (2006.01)
*H04R 5/02* (2006.01)

(52) U.S. Cl.
USPC ..... 381/310; 381/17; 381/306

(58) Field of Classification Search
USPC ..... 381/310
See application file for complete search history.

(56) References Cited

U.S. PATENT DOCUMENTS 4,569,074 A * 2/1986 Polk ..... 381/304
4,630,298 A * 12/1986 Polk et al. ..... 381/1
5,459,790 A * 10/1995 Scofield et al. ..... 381/310
5,581,618 A * 12/1996 Satoshi et al. ..... 381/17
5,862,227 A * 1/1999 Orduna-Bustamante et al. ..... 381/17
5,870,484 A * 2/1999 Greenberger ..... 381/300
6,553,121 B1 * 4/2003 Matsuo et al. ..... 381/17
6,937,737 B2 * 8/2005 Polk, Jr. ..... 381/300
7,167,567 B1 * 1/2007 Sibbald et al. ..... 381/17
7,289,633 B2 * 10/2007 Metcalf ..... 381/17
7,515,719 B2 * 4/2009 Hooley et al. ..... 381/18
7,577,260 B1 * 8/2009 Hooley et al. ..... 381/77
2004/0151325 A1 * 8/2004 Hooley et al. ..... 381/18
2004/0170284 A1 * 9/2004 Janse et al. ..... 381/66
2005/0008170 A1 * 1/2005 Pfaffinger et al. ..... 381/96

(Continued)

FOREIGN PATENT DOCUMENTS

JP 2006-246310 9/2006
JP 2007-208318 8/2007
KR 10-2001-0001993 A 1/2001
KR 10-2006-0026730 A 3/2006

OTHER PUBLICATIONS

Korean Notice of Allowance issued Nov. 22, 2012 in corresponding Korean Patent Application 10-2007-0103733.

*Primary Examiner* — Alexander Talpalatski
(74) *Attorney, Agent, or Firm* — Staas & Halsey LLP

(57) ABSTRACT

A method and apparatus for compensating for a near-field effect in a speaker array system is provided. The method includes generating a virtual sound signal at a position, which is separated from a speaker array by a predetermined distance, based on an input sound signal, and outputting the generated virtual sound signal using the speaker array. Therefore, the near-field effect, in which a sound radiated from a speaker array is distorted to have non-uniform radiation characteristics near the speaker array, can be compensated for. Consequently, the method and apparatus can provide a stable sound field, into which non-uniform radiation characteristics uniformly converge, to a listener.

14 Claims, 7 Drawing Sheets

(56) References Cited

U.S. PATENT DOCUMENTS

2005/0089181 A1* 4/2005 Polk ..... 381/300
2005/0207583 A1* 9/2005 Christoph ..... 381/57
2006/0062411 A1* 3/2006 Sako et al. ..... 381/310
2006/0083389 A1* 4/2006 Oxford et al. ..... 381/92
2006/0133628 A1* 6/2006 Trivi et al. ..... 381/310
2007/0110250 A1* 5/2007 Bauck ..... 381/20

* cited by examiner

METHOD AND APPARATUS FOR COMPENSATING FOR NEAR-FIELD EFFECT IN SPEAKER ARRAY SYSTEM

CROSS-REFERENCE TO RELATED APPLICATIONS

This application claims the priority of Korean Patent Application No. 10-2007-0103733, filed on Oct. 15, 2007, in the Korean Intellectual Property Office, the disclosure of which is incorporated herein in its entirety by reference.

BACKGROUND

1. Field

One or more embodiments of the present invention relate to a speaker array system including a plurality of speakers and a signal processing method used by the speaker array system, and more particularly, to a method and apparatus for compensating for a near-field effect in which a sound output from a speaker array is distorted when a listener moves close to the speaker array, wherein the apparatus is included in a speaker array system.

2. Description of the Related Art

A speaker array including a plurality of speakers is used to control the direction of a sound, which is to be reproduced by the speaker array, or send the sound to a specific region. In order to direct a sound toward a target position or in a target direction, an array including a plurality of sound sources is required. A sound propagation principle, called "directivity," is directed to overlapping a plurality of sound signals using phase differences between them so as to increase signal intensity in a specified direction and transmit the sound signals in the specified direction. Therefore, directivity can be achieved by controlling sound signals which are output from a plurality of speakers arranged at predetermined positions.

When sound signals are output from a speaker array, the sound signals radiated from a plurality of speakers in the speaker array distort each other in a region within a predetermined distance away from the speaker array. Thus, non-uniform radiation characteristics of the sound signals are found in this region. This phenomenon, which is called "near-field effect," occurs because the individual sound signals radiated from the speakers cannot form respective sound fields near the speaker array.

As used herein, the term "sound source" denotes a source which radiates sounds, that is, an individual speaker included in a speaker array. In addition, the term "sound field" denotes a virtual region formed by a sound which is radiated from a sound source, that is, a region which sound energy reaches. The term "sound pressure" denotes the power of sound energy which is represented using the physical quantity of pressure.

SUMMARY

One or more embodiments of the present invention provide an apparatus and method for compensating for a near-field effect in a speaker array system, the apparatus and method capable of removing the near-field effect, thus making it easy to control sound near the speaker array. Near-field effect describes a phenomenon in which a sound radiated from a speaker array is distorted to have non-uniform radiation characteristics near the speaker array.

Additional aspects and/or advantages will be set forth in part in the description which follows and, in part, will be apparent from the description, or may be learned by practice of the invention.

According to an aspect of the present invention, a method of compensating for a near-field effect is provided. The method includes: generating a virtual sound signal at a position, which is separated from a speaker array by a predetermined distance, based on an input sound signal; an outputting the generated virtual sound signal using the speaker array.

According to another aspect of the present invention, a computer-readable recording medium is provided. The computer-readable recording medium is a medium on which a program for executing the above method is recorded.

According to another aspect of the present invention, an apparatus for compensating for a near-field effect is provided. The apparatus includes: a virtual sound signal generating unit generating a virtual sound signal at a position, which is separated from a speaker array by a predetermined distance, based on an input sound signal; and a signal output unit outputting the generated virtual sound signal using the speaker array.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF EMBODIMENTS

Figure 1:
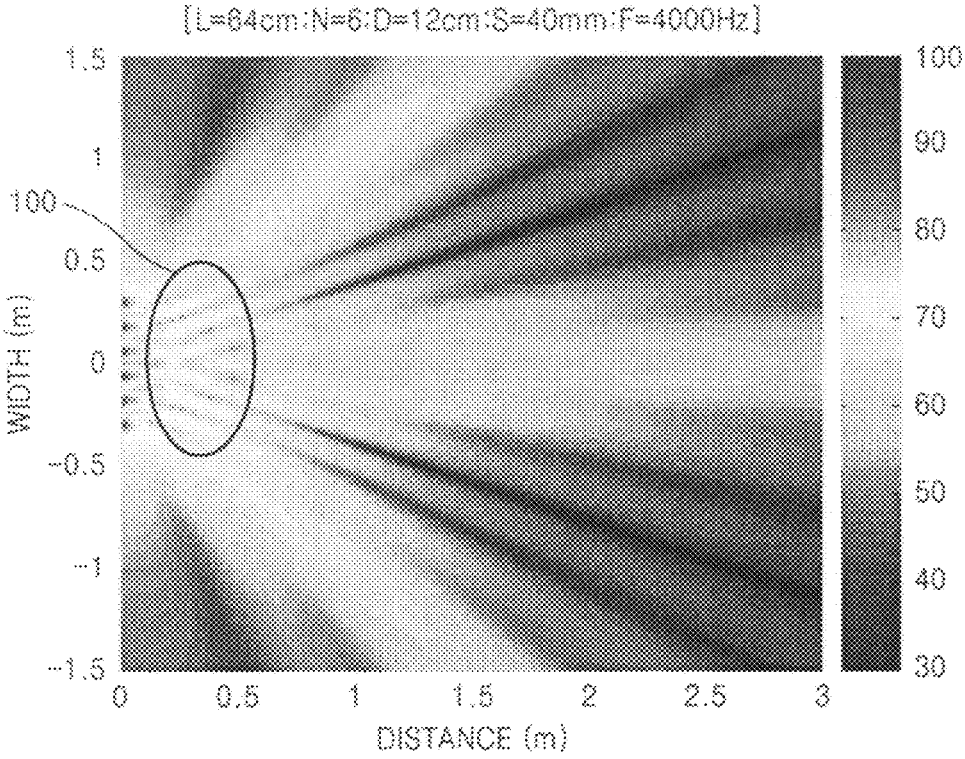
FIG. 1 illustrates a near-field effect which occurs near a speaker array.

Reference will now be made in detail to embodiments, examples of which are illustrated in the accompanying drawings, wherein like reference numerals refer to the like elements throughout. Embodiments are described below to explain the present invention by referring to the figures.

FIG. 1 illustrates a near-field effect that occurs near a speaker array. Specifically, FIG. 1 illustrates the variation in radiation characteristics of a sound signal according to the distance from the speaker array. In a radiation pattern illustrated in FIG. 1, a horizontal axis represents the distance from the speaker array, and a vertical axis represents the distance from the center of the speaker array to each edge thereof. That is, FIG. 1 illustrates a situation where the speaker array is located on a plane to the left side of the vertical axis and where a sound is radiated from left to right.

As described above, the near-field effect refers to a phenomenon in which sound radiated from a speaker array is distorted in a region near the speaker array. The near-field effect can be identified from a non-uniform radiation pattern of the sound. Referring to FIG. 1, a region 100 located within a circle shows a non-uniform radiation pattern. In this region 100, a plurality of sounds output from a plurality of speakers in the speaker array interfere with and thereby distort each other. Thus, when a user is located closer to the speaker array than the region 100 having the near-field effect, the user can hardly hear certain sounds output from the speaker array. Within the distance of approximately 0.5 m by which the region 100 having the non-uniform radiation pattern is separated from the speaker array, radiation characteristics cannot be uniformly controlled. Thus, the user can hardly hear sounds.

In particular, while a relatively sufficient distance is maintained between a user and audio devices used at home, the distance between the user and small-sized audio devices (such as mobile phones, digital multimedia broadcasting (DMB) players and portable multimedia players (PMPs)) that the user can carry to view, for example, moving images, notebook personal computers (PCs) or monitors having built-in speakers is very close. In this case, the probability that the near-field effect will occur increases. In this regard, a speaker array system, which can constrain the occurrence of the near-field effect and properly output a sound signal even when the distance between a user and a speaker array is close, is required.

Figure 2:
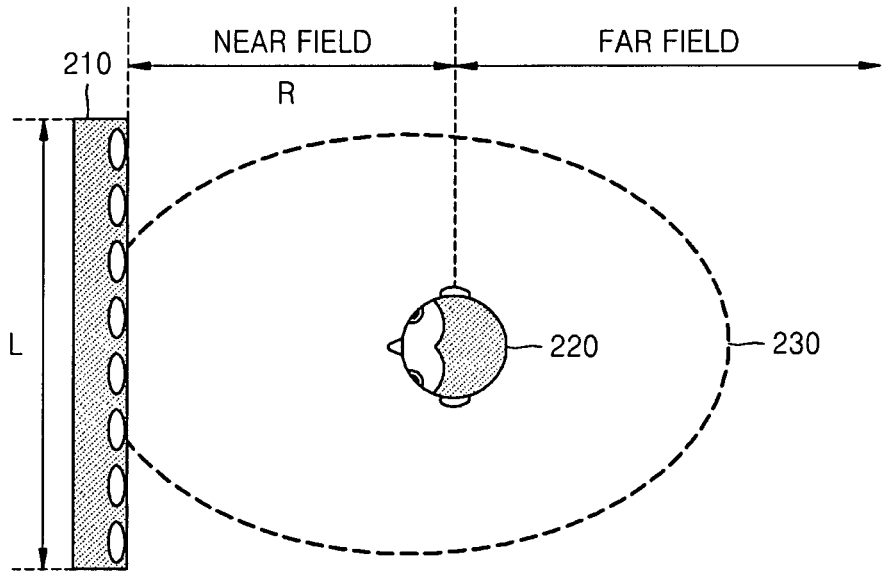
FIG. 2 illustrates the relationship between a speaker array system and the near-field effect which occurs near a speaker array.

FIG. 2 illustrates the relationship between a speaker array system and the near-field effect, which occurs near a speaker array 210. In FIG. 2, it is assumed that a listener 220 listens to a sound radiated from the speaker array 210. A region indicated by a dotted line 230 is a visual representation of a sound field formed by a sound radiated from the speaker array 210.

Since the near-field effect occurs near a speaker array, a region having the near-field effect is referred to as a near field, and a region located further from the speaker array and therefore not experiencing the near-field effect is referred to as a far field. As described above with reference to FIG. 1, as a listener moves from the near field to the far field, sounds showing non-uniform radiation characteristics converge to form a single sound field. Here, a region in which a change of sound field occurs is referred to as a transition region. The transition region may vary according to physical characteristics of the speaker array, such as the aperture size of the speaker array, and attributes of a sound radiated from the speaker array, such as a wavelength of the sound.

More specifically, it is generally known that sound pressure at a position a predetermined distance away from a speaker array is determined by a sound propagation equation. The sound propagation equation may be defined as a function of the distance between a position and a sound source and an angle formed by the position and the sound source. Using the defined sound propagation equation (also referred to as a reaction model), a radiation pattern of a sound radiated from a speaker array may be defined. Thus, a position, at which the near-field effect disappears, may be set to the transition region. The relationship between the physical characteristics of a speaker array, attributes of a sound radiated from the speaker array, and the distance between the speaker array and the transition region may be defined by Equation (1) below.

$$R_{\min} = \frac{1}{4} \cdot \frac{L^2}{\lambda} \qquad \text{Equation (1)}$$

$$L = \sqrt{R_{\min} \cdot \lambda \cdot 4}$$

where R denotes the distances at which a listener can hear a sound without experiencing the near-field effect, that is, the distances by which all regions included in the far field are separated from the speaker array, respectively. $R_{min}$ denotes a minimum value from among values of the distances R, that is, the distance between the speaker array and the transition region in which the near field changes to the far field. In addition, L indicates the aperture size of the speaker array, and λ indicates a wavelength of a sound signal. When a sound signal, which is to be output from the speaker array, has various wavelengths, the transition region may be formed at a different distance away from the speaker array according to the wavelength. However, in the following embodiments of the present invention, it is assumed that the values of the distances R encompassing these various distances are used.

When a listener hears a sound from a position located a large distance away from a speaker array, there is no concern about the near-field effect. Therefore, it is important to identify $R_{min}$, that is, the distance between the speaker array and the transition region. According to Equation (1), the distance between the speaker array and the transition region is proportional to the aperture size L of the speaker array and inversely proportional to the wavelength λ of a sound signal. However, the aperture size L of the speaker array in the speaker array system is generally fixed, and the wavelength λ also cannot be arbitrarily changed. Thus, it is difficult to efficiently control the near-field effect in reality. Therefore, a principle, which may help provide a better understanding of the present invention, will first be explained before various embodiments of the present invention for compensating for the near-field effect are described in more detail.

Figure 3:
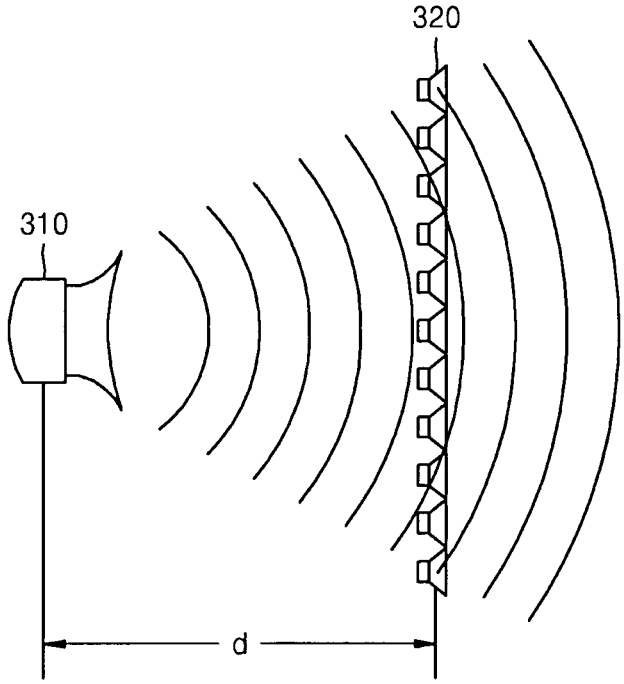
FIG. 3 illustrates the relationship between a first sound source and a second sound source based on Huygens' principle.

FIG. 3 illustrates the relationship between a first sound source and a second sound source based on Huygens' principle. Huygens' principle is used to pictorially represent wavefronts of a wave travelling in space. According to Huygens' principle, when a wavefront is given at a point of time, a wavefront at a next point of time is an envelope which contacts all spherical waves generated by a plurality of points, which serve as independent wave sources, on the given wavefront. Specifically, referring to FIG. 3, a sound is radiated from a large speaker 310 on the left. The large speaker 310 is a speaker that actually exists and corresponds to a wavefront given at a point of time in Huygens' principle. The large speaker 310 may be referred to as the first sound source, and a sound field formed by the sound, which is radiated from the first sound source, may be obtained at a position separated from the large speaker 310 by a distance d. Then, the sound field may be reproduced by a plurality of small speakers 320 as illustrated in FIG. 3. In this case, the small speakers 320 may correspond to a wavefront at a next point of time in Huygens' principle and may be referred to as a second sound source. According to Huygens' principle, the wavefront of the second sound source is induced from spherical waves formed on the wavefront of a sound radiated from the first sound source. Therefore, even when a sound field formed by a sound radiated from the large speaker 310 is reproduced using the small speakers 320 and is obtained at a location separated from the large speaker 310 by the distance d, the effect can be the same as if the sound were radiated from the large speaker 310.

In embodiments of the present invention, the second sound source (the small speakers 320) is used to output a sound signal according to Huygens' principle. However, the effect that can be obtained with the small speakers 320 can be the same as if the first sound source (the large speaker 310) were used to output the sound signal.

Additional effects that can be achieved when the second sound source instead of the first sound source is used to output a sound signal, and a method of controlling the near-field effect described above, will now be described in greater detail with reference to FIGS. 4A and 4B.

Figure 4A:
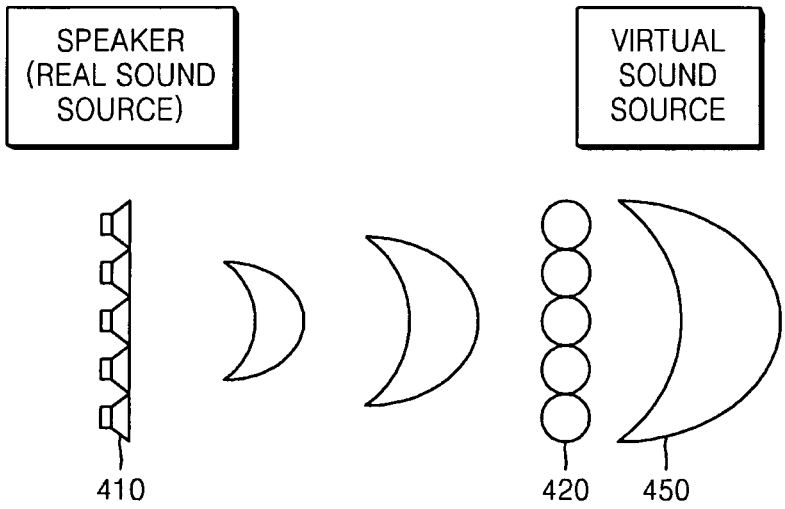
FIGS. 4A and 4B explain the principle for compensating for the near-field effect using a real sound signal and a virtual sound signal which are output from a speaker.
Figure 4B:
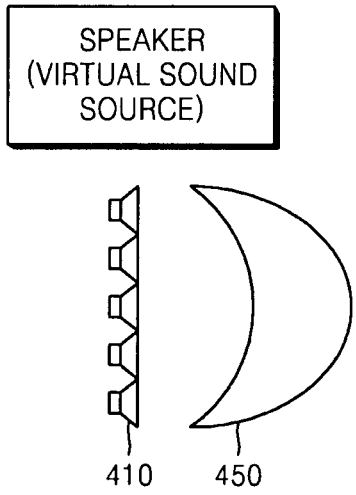

FIGS. 4A and 4B explain the principle for compensating for the near-field effect using a real sound signal and a virtual sound signal which are output from a speaker. Specifically, FIG. 4A illustrates a situation in which a speaker array 410 including a plurality of speakers outputs a sound signal. It is assumed that there exists a virtual sound source 420 to form a sound field 450 at a position which is located a predetermined distance away from the speaker array 410. According to Huygens' principle, the speaker array 410 corresponds to the first sound source, and the virtual sound source 420 corresponds to the second sound source. That is, the sound field 450 formed at the position located the predetermined distance away from the speaker array 410, is identical to a sound field formed by a sound signal which is output from the virtual sound source 420.

FIG. 4B illustrates a situation in which a speaker array 410 functions as the virtual sound source 420 of FIG. 4A and outputs a virtual sound signal. The situation in FIG. 4B may be identical to the situation in FIG. 4A in that a sound signal is output from the speaker array 410. However, they are different in that the speaker array 410 of FIG. 4A, which is the first sound source, outputs a real sound signal while the speaker array 410 of FIG. 4B, which is the second sound source, outputs a virtual sound signal. Therefore, the sound field 450 formed by a sound signal output from the speaker array 410 of FIG. 4B is identical to a sound field 450 formed by a sound signal output from the virtual sound source 420 which corresponds to the second sound source of FIG. 4A. As a result, the effect, which can be obtained when the real speaker array 410 is moved backward from a current position thereof by the distance between the real speaker array 410 and the virtual sound source 420, can be obtained.

If the distance between a virtual sound source and a real speaker array is greater than the distance within which the near-field effect occurs, when the speaker array 410 of FIG. 4B, which corresponds to the virtual sound source, outputs a virtual sound signal, the sound field 450 formed by the virtual sound signal may not exhibit the near-field effect. This is because the effect, which can be obtained when the speaker array 410 of FIG. 4B is moved in an opposite direction to the direction in which it outputs a virtual sound signal by the distance between the real speaker array and the virtual sound source, can be obtained. Therefore, the problem of a non-uniform radiation pattern due to the near-field effect can be addressed. If the distance between the virtual sound source and the real speaker array is less than the distance within which the near-field effect occurs, a virtual sound signal output from the speaker array 410 of FIG. 4B may have a minor near-field effect in front of the speaker array 410 of FIG. 4B. However, even in this case, since the distance within which the near-field effect occurs is less than that when the speaker array 410 of FIG. 4A outputs a real sound signal, non-uniform radiation can be reduced.

Figure 5:
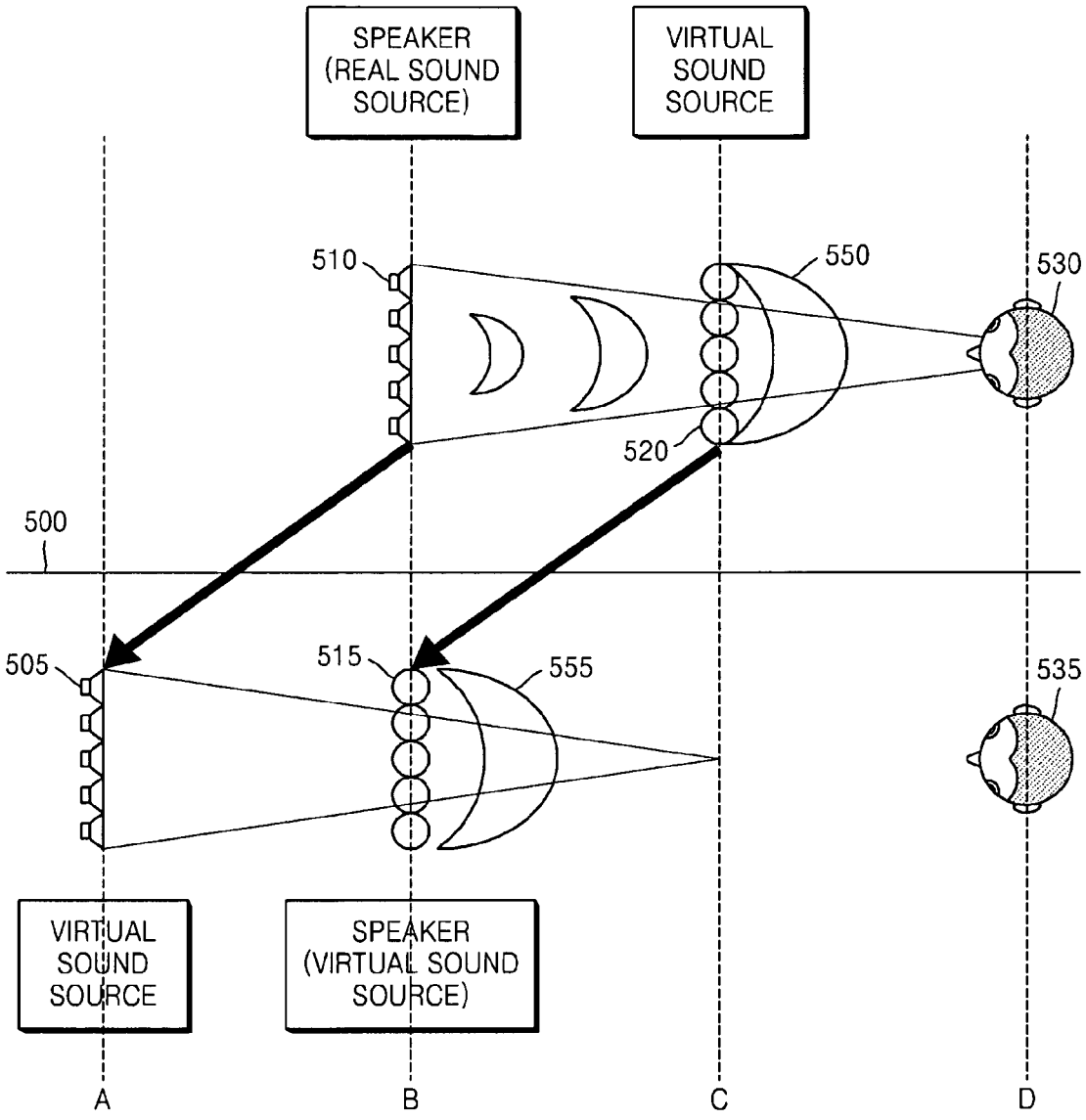
FIG. 5 explains the principle for compensating for the near-field effect in a speaker array system, according to an embodiment of the present invention.

FIG. 5 explains the principle for compensating for the near-field effect in a speaker array system, according to an embodiment of the present invention. In FIG. 5, the distance between a listener and a speaker array is illustrated based on the principle of FIGS. 4A and 4B. FIG. 5 illustrates two situations in which speaker arrays 510 and 515 and listeners 530 and 535 are located with respect to a horizontal solid line 500. The upper and lower situations of FIG. 5 correspond to the situations of FIGS. 4A and 4B, respectively. Vertical dotted lines A through D are used to indicate the positions of a virtual speaker 505, the speaker arrays 510 and 515, a virtual sound source 550, and the listeners 530 and 535. In addition, a triangle formed between the speaker array 510 and the listener 530 above the solid line 500 indicates a region in which the near-field effect occurs.

The speaker array 510 illustrated above the solid line 500 corresponds to a first sound source and outputs a real sound signal. A sound radiated from the speaker array 510 at the position B may form a sound field 550 at the position C and may be delivered to the listener 530 located at the position D. As described above with reference to FIG. 4A, a virtual sound radiated from a virtual sound source 520 can be obtained at the position C from the sound output from the speaker array 510. The virtual sound source 520 corresponds to a second sound source, and the virtual sound radiated from the virtual sound source 520 forms the sound field 550. Since a method of obtaining a virtual sound will be described in more detail with reference to FIG. 6, the principle of compensating for the near-field effect will be described in greater detail here.

The speaker array 515 illustrated under the solid line 500 is a real speaker but corresponds to the above-illustrated virtual sound source 520, which is the second sound source. The speaker array 515 outputs a virtual sound signal corresponding to the virtual sound, which was radiated from the virtual sound source 520 and obtained at the position D, and the virtual sound signal forms a sound field 555. In this case, the sound field 555 is identical to the sound field 550 formed by the virtual sound which was radiated from the virtual sound source 520 above. Therefore, even if the speaker array 515 located at the position B outputs the virtual sound signal corresponding to the virtual sound radiated from the virtual sound source 520, the listener 535 located at the position D perceives the virtual sound signal as if it was output from a virtual speaker array 505 located at the position A. That is, an effect can be obtained as if the speaker array 515 is moved backward from its current position, i.e., moved from the position C to the position B. Here, the distance between the positions A and B is equal to the distance between the positions B and C. Consequently, the near-field effect disappears before a sound radiated from the virtual speaker array 505 at the position A reaches the listener 535 located at the position D. Thus, the listener 535 hears a stable sound from which the near-field effect has been removed.

Hereinafter, various embodiments of the present invention will be suggested based on the principle for compensating for the near-field effect.

Figure 6:
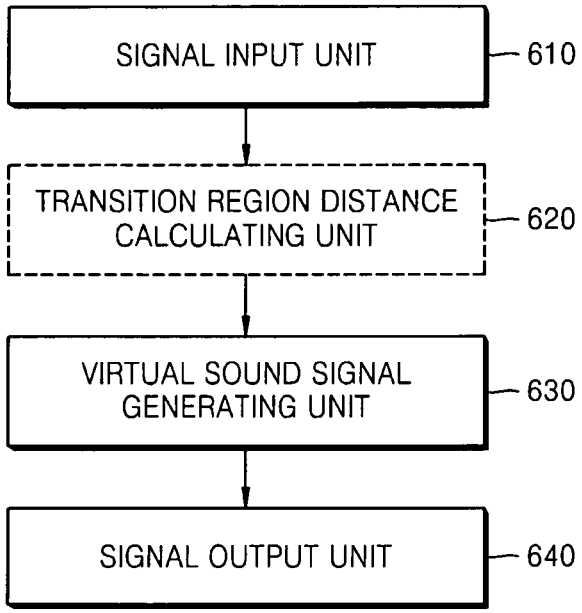
FIG. 6 illustrates an apparatus for compensating for the near-field effect in a speaker array system, according to an embodiment of the present invention.

FIG. 6 illustrates an apparatus for compensating for the near-field effect in a speaker array system, according to an embodiment of the present invention. Referring to FIG. 6, the apparatus may include, for example, a signal input unit 610, a transition region distance calculating unit 620, a virtual sound signal generating unit 630, and a signal output unit 640. The signal input unit 610 receives a sound, which is to be output from the speaker array system, and makes copies of the received sound, such that the number of copies equals the number of channels that form the speaker array. In addition, the signal input unit 610 may perform various signal processing operations in order to control characteristics of a sound which is to be radiated, such as directivity or focusing. For example, the signal input unit 610 may process signal delays or gains.

The transition region distance calculating unit 620 calculates the distance between the speaker array and the transition region in which the near-field effect disappears. The distance is as described above with reference to Equation 1. The transition region distance calculating unit 620 is optional and can be omitted when necessary for the following reasons.

As described above, embodiments of the present invention work based on the principle that the real speaker array reproduces a virtual sound as if the virtual sound was reproduced by a virtual speaker array, which is moved from the position of the real speaker array away from the user by a distance equal to the distance in which the near-field effect occurs. Therefore, a distance needs to be lengthened greater than the distance between the real speaker array and the transition region in order to completely remove the near-field effect from the virtual sound radiated from the speaker array.

However, it is very rare for a listener to hear sound right in front of the speaker array of the speaker array system. Consequently, even when the distance between the listener and the speaker array is less than the distance between the speaker array and the transition region, it is not necessarily required to calculate the distance between the speaker array and the transition region and apply the calculated distance to the generation of a virtual sound, considering that the listener generally listens to sound at a position a reasonable distance away from the speaker array system. However, the distance between the speaker array and a virtual sound source must be predetermined to an appropriate distance, so that the near-field effect does not occur at the position of the virtual sound source. The distance between the speaker array and the virtual sound source may be experimentally obtained or may be flexibly applied according to an environment in which embodiments of the present invention are implemented.

The virtual sound signal generating unit 630 generates a virtual sound signal at a position located a specified distance from the speaker array based on a sound signal received from the signal input unit 610. The specified distance may be a distance calculated by the transition region distance calculating unit 620 or a distance calculated in advance such that the near-field effect does not occur at the position where the virtual sound signal is generated. A method of generating a virtual sound signal is broadly classified into an experimental method, a numerical analysis method, and a theoretical method, each of which will now be described in more detail. In particular, the following description will focus on the experimental method.

In the experimental method, a specified sound signal is transmitted to each individual speaker in a speaker array. Then, the speaker array outputs a sound signal. In this case, the specified sound signal is a test sound used to measure the sound signal output from the speaker array. The specified sound signal may be an impulse signal or white noise uniformly containing all frequency components. The sound signal output from the speaker array is measured by a measurer, such as a microphone array, at the position (a predetermined distance away from the speaker array) of a virtual sound source.

Based on the measurement result, a transfer function, which corresponds to the relationship between the sound signal output from the speaker array and a sound signal measured by the microphone array, may be obtained. In a narrow sense, the transfer function denotes a ratio of sound signals into which the sound signal output from the speaker array, which corresponds to the first sound source, and the sound signal measured at the position of the virtual sound source, which corresponds to the second sound source, are Fourier-transformed. In a broad sense, the transfer function denotes a function indicating signal transfer characteristics from an input signal to an output signal. The calculated transfer function is multiplied by a real sound, which is to be output from the speaker array, to generate a virtual sound signal.

In the numerical analysis method, it is assumed that a sound source exists at the position of each individual speaker in the speaker array. Based on this assumption, the sound pressure of a sound radiated from each sound source is calculated at any one of the positions of a plurality of virtual sound sources. Then, values of the calculated sounds are added to produce a transfer function for the position of one virtual sound source. The sound pressure of a virtual sound radiated from each individual virtual sound source may be defined by Equation 2 below.

$$p(i, t) = \sum_{k=1}^{N} P(x, t) \qquad \text{Equation 2}$$

where P(x, t) indicates the sound pressure of a sound radiated from an individual speaker in the speaker array at the position of a virtual sound source, x indicates the distance between the individual speaker and the position of the virtual sound source, t indicates time, and N indicates the number of individual speakers in the speaker array. That is, Equation 2 produces the sum of sound pressures of sounds radiated from the individual speakers of the speaker array at the position of one virtual sound source. If the above process is performed as many times as the number of virtual sound sources, a transfer function for all virtual sounds can be obtained. A subsequent process is identical to the above experimental method.

Major examples of the numerical analysis method include a finite element method (FEM) and a boundary element method (BEM), which have been utilized to calculate an approximate solution in a differential equation that cannot be directly calculated. Specific processes of these numerical analysis methods are easily understood by those of ordinary skill in the art, and thus a detailed description thereof will be omitted.

The theoretical method calculates a transfer function purely through mathematical inducement. A major example of the theoretical method is Green's function. Green's function is used to solve a differential equation for obtaining an impulse response of a system under a specified boundary condition. Specific processes of calculating Green's function are also easily understood by those of ordinary skill in the art, and thus a detailed description thereof will be omitted.

The virtual sound signal generating unit 630, which generates a virtual sound signal according to various embodiments of the present invention, have been described above with reference to FIG. 6.

Once the virtual sound signal generating unit 630 generates a virtual sound signal, the signal output unit 640 outputs the generated virtual sound signal through the speaker array. Consequently, a listener may perceive the virtual sound signal output from the speaker array as if the virtual sound signal was output from a virtual speaker array, which is separated backward from the speaker array by a predetermined distance. Accordingly, the near-field effect is compensated for by the distance between the speaker array and a virtual sound source.

Figure 7A:
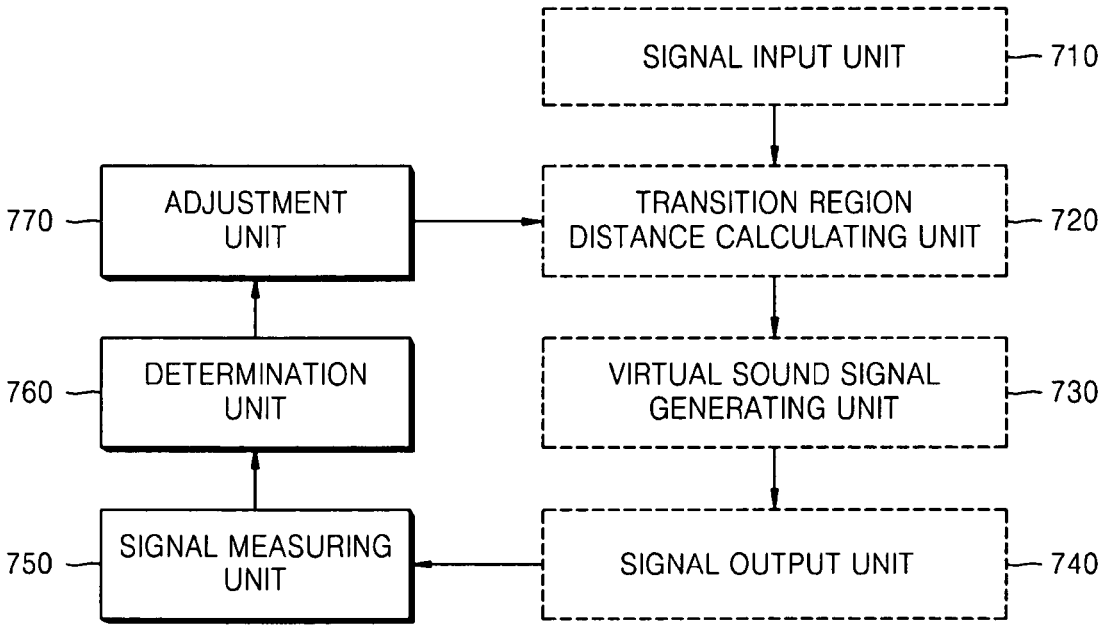
FIGS. 7A and 7B illustrate apparatuses for compensating for the near-field effect in a speaker array system, according to an embodiment of the present invention.

FIG. 7A illustrates an apparatus for compensating for the near-field effect in a speaker array system, according to another embodiment of the present invention. Referring to FIG. 7A, the apparatus may include, for example, a signal measuring unit 750, a determination unit 760, and an adjustment unit 770 in addition to a signal input unit 710, a transition region distance calculating unit 720, a virtual sound signal generating unit 730, and a signal output unit 740, which are identical to those of the apparatus illustrated in FIG. 6. For simplicity, a description of elements substantially identical to those of the previous embodiment illustrated in FIG. 6 will be omitted, and the additional elements 750, 760 and 770 will mainly be described in the present embodiment.

The signal measuring unit 750 measures a virtual sound signal output from the signal output unit 740. The signal measuring unit 750 includes all sound input mediums which can be used to collect sound waves, such as a microphone array.

The determination unit 760 determines whether the near-field effect has been removed from the virtual sound signal based on the measurement result of the signal measuring unit 750. Since a sound signal having the near-field effect cannot form a uniform sound field, a slight position change in a region in which the near-field effect occurs may translate into a great change in the sound pressure of the sound signal. Thus, the determination unit 760 detects the change in the sound pressure and determines that the near-field effect has not been properly removed from the virtual sound signal by the virtual sound signal generating unit 730 if the change in the sound pressure exceeds a predetermined level. In this case, the predetermined level may be flexibly determined according to embodiments of the present invention.

The adjustment unit 770 selectively adjusts the distance between a speaker array and a virtual sound source according to the determination result of the determination unit 760. If the determination unit 760 determines that the near-field effect has been properly removed from the virtual sound signal, a speaker array system may continue to compensate for the near-field effect as it currently does. If the determination unit 760 determines that the near-field effect has not been properly removed from the virtual sound signal, the distance between the speaker array and the virtual sound source must be adjusted. The adjustment of the distance between the speaker array and the virtual sound source is required when a listener is located in the near field. Therefore, adjusting the distance generally refers to increasing the distance between the array speaker and the virtual sound source.

The additional three elements may be useful for a speaker array system which does not include the transition region distance calculating unit 720. This is because the near-field effect may not be effectively compensated for when the speaker array system does not include the transition region distance calculating unit 720, and thus when the distance between a speaker array and a virtual sound source is set to an arbitrary distance. Therefore, when the near-field effect has not been properly compensated for, additional compensation may be provided by the signal measuring unit 750, the determination unit 760, and the adjustment unit 770 as a follow-up operation.

The additional three elements may also be useful even for a speaker array system that includes the transition region distance calculating unit 720. This is because the near-field effect may not be completely removed from a virtual sound signal even if the virtual sound signal generating unit 730 generates the virtual sound signal based on the distance between the speaker array and the virtual sound source, which is calculated by the transition region distance calculating unit 720.

The experimental method, the numerical analysis method and the theoretical method according to various embodiments of the present invention cannot reflect all environmental variables, such as directivity. In addition, in these methods, some environmental variables may be excluded or assumed to be simple values for ease of calculation. For this reason, even if a virtual sound signal is generated using any one of the above methods, the virtual sound signal output from the signal output unit 740 may have unexpected errors. However, the speaker array system according to the present invention can completely remove such unexpected errors using the additional three elements and thus compensate for the near-field effect in a more reliable manner.

Figure 7B:
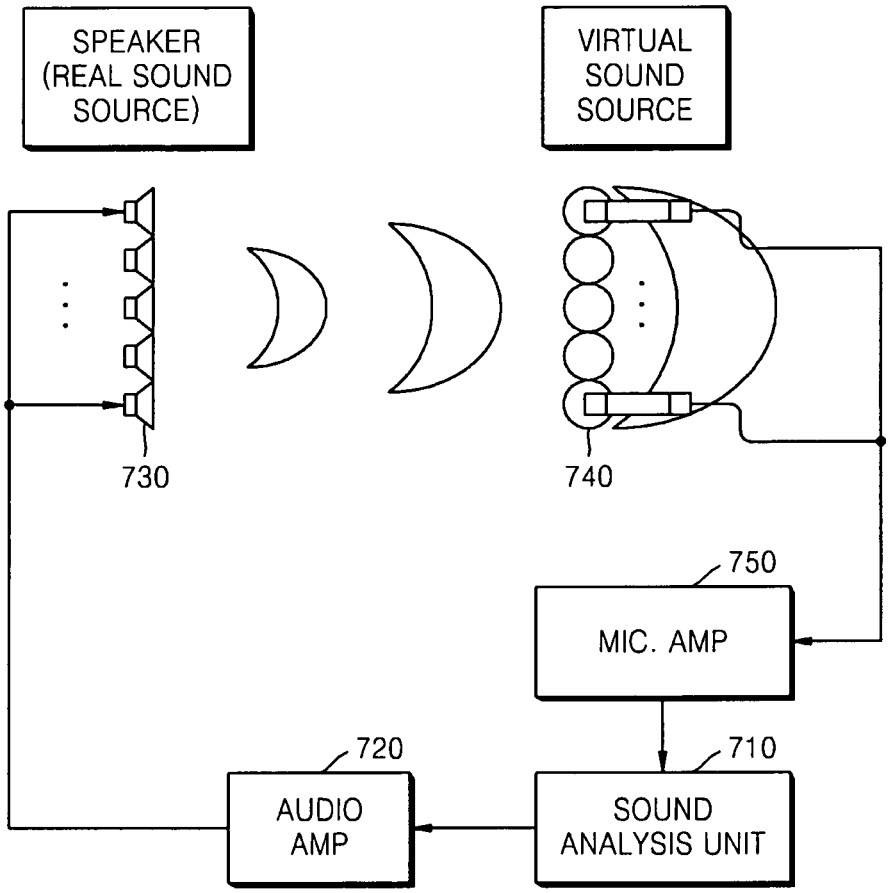

FIG. 7B illustrates an apparatus for compensating for the near-field effect in a speaker array system, according to another embodiment of the present invention. The configuration of the apparatus according to the present embodiment is based on the assumption that the virtual sound signal generating unit 630 uses the experimental method to generate a virtual sound signal.

A sound analysis unit 710 generates a specified sound signal used to measure a sound signal at the position of a virtual sound source. An audio amplifier 720 amplifies the generated sound signal to a size required for measurement, makes a quantity of copies of the amplified sound signal equal to the number of individual speakers in a speaker array 730, and transmits the copies of the amplified sound signal to the individual speakers, respectively. Then, a sound field of a sound signal output from the speaker array 730 is measured by a signal measurer 740, which is located at the position of a virtual sound source. In this case, the signal measurer 740 may be a microphone array including a number of microphones equal to the number of the individual speakers in the speaker array 730.

As illustrated in FIG. 7B, when the number of individual speakers in the speaker array 730 is five, the number of microphones of the signal measurer 740 corresponding to the speaker array 730 is also five. The measured sound signal is amplified by a microphone array amplifier 750 and then input to the sound analysis unit 710. Then, the sound analysis unit 710 calculates a transfer function for a virtual sound signal based on the relationship between the sound signal output from the speaker array 730 and the sound signal input to the signal measurer 740. The calculated transfer function is multiplied by a sound signal which is to be output from the speaker array 730, thereby generating a virtual sound signal. Here, the distance between the speaker array 730 and the signal measurer 740 may be appropriately adjusted using a signal measuring unit (not shown), a determination unit (not shown) and an adjustment unit (not shown).

Figure 8:
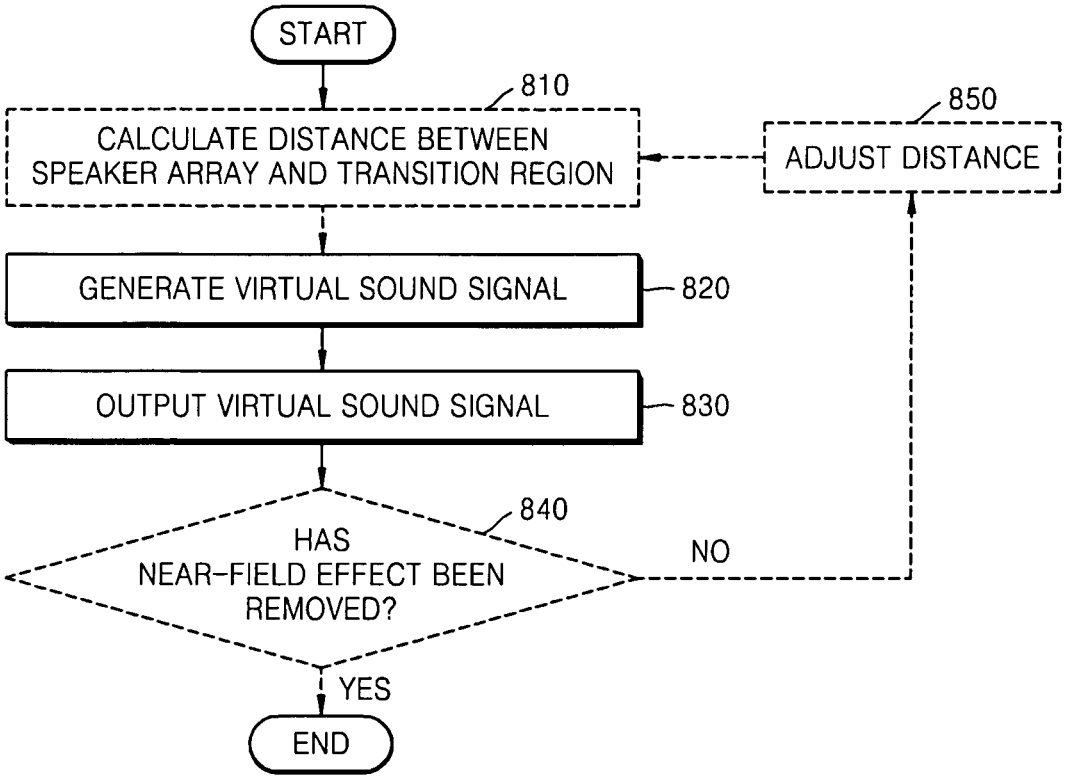
FIG. 8 illustrates a method of compensating for the near-field effect in a speaker array system, according to an embodiment of the present invention.

FIG. 8 illustrates a method of compensating for the near-field effect in a speaker array system, according to an embodiment of the present invention.

Referring to FIG. 8, the distance between a speaker array and a transition region in which the near-field effect disappears is calculated in operation 810. Operation 810 corresponds to the operation performed by the transition region distance calculating unit 720 of FIG. 7A and may be omitted when necessary. When operation 810 is omitted, an operation in which the distance between the speaker array and the transition region is set to an arbitrary distance is required.

In operation 810, a virtual sound signal is generated at a position, which is separated from the speaker array by the distance calculated in operation 810 (or an arbitrary distance set in advance), based on a sound radiated from the speaker array. Operation 810 corresponds to the operation performed by the virtual sound signal generating unit 730 of FIG. 7A.

In operation 830, the virtual sound signal generated in operation 820 is output from the speaker array. Operation 830 corresponds to the operation performed by the signal output unit 740 of FIG. 7A. As mentioned above in relation to FIG. 7A, subsequent operations are optional.

In operation 840, the virtual sound signal output in operation 830 is measured, and it is determined whether the near-field effect has been removed from the virtual sound signal based on the measurement result. Operation 840 corresponds to the operations performed by the signal measuring unit 750 and the determination unit 760 of FIG. 7A. If it is determined that the near-field effect has been removed, the process is terminated. However, if it is determined that the near-field effect has not be removed, operation 850 is performed. Termination of the process does not refer to a situation in which the speaker array system stops outputting a sound signal. Rather, termination of the process refers to a situation in which the process of compensating for the near-field effect is terminated and the currently generated virtual sound signal is continuously output.

If it is determined in operation 840 that the near-field effect has not been removed, the distance between the speaker array and a virtual sound source is adjusted in operation 850. Operation 850 corresponds to the operation performed by the adjustment unit 770 of FIG. 7A.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A method of compensating for a near-field effect, the method comprising:

calculating a distance between a speaker array and a transition region in which the near-field effect disappears in a sound signal output from the speaker array, the near-field effect being a phenomenon in which a sound radiated from the speaker array comprises a non-uniform radiation pattern;

generating a virtual sound signal using a sound signal formed at a position located the calculated distance away from the speaker array; and outputting the generated virtual sound signal using the speaker array.

2. The method of claim 1, wherein the generating of the virtual sound signal comprises:

calculating a transfer function corresponding to the relationship between a sound signal output from the speaker array and the virtual sound signal; and generating the virtual sound signal at the position, which is separated from the speaker array by the calculated distance, by multiplying the transfer function by a real sound signal which is to be output from the speaker array.

3. The method of claim 2, wherein the calculating of the transfer function comprises:

outputting a sound signal using the speaker array; and measuring the sound signal, which is output from the speaker array, at the position separated from the speaker array by the calculated distance, and calculating the transfer function corresponding to the relationship between the sound signal output from the speaker array and the measured sound signal.

4. The method of claim 2, wherein the calculating of the transfer function comprises:

calculating sound pressure at the position which is separated from the speaker array by the calculated distance; and calculating the transfer function, which corresponds to the relationship between the sound signal output from the speaker array and a sound signal at the position, based on the calculated sound pressure and using a predetermined numerical analysis method.

5. The method of claim 1, further comprising:

measuring the output virtual sound signal;

determining whether the near-field effect has been removed from the output virtual sound signal based on the measurement result; and selectively adjusting the distance based on the determination result.

6. The method of claim 1, further comprising calculating the distance between the speaker array and the transition region in consideration of the sound signal which is to be output from the speaker array and physical characteristics of the speaker array.

7. A non-transitory computer-readable recording medium on which a program for executing the method of claim 1 is recorded.

8. An apparatus for compensating for a near-field effect, the apparatus comprising:

a transition region distance calculating unit to calculate a distance between a speaker array and a transition region in which the near-field effect disappears in a sound signal output from the speaker array, the near-field effect being a phenomenon in which a sound radiated from the speaker array comprises a non-uniform radiation pattern;

a virtual sound signal generating unit generating a virtual sound signal using a sound signal formed at a position located the distance away from the speaker array calculated by the transition region distance calculating unit; and a signal output unit outputting the virtual sound signal generated the by virtual sound signal generating unit using the speaker array.

9. The apparatus of claim 8, wherein the virtual sound signal generating unit comprises:

a transfer function calculating unit calculating a transfer function corresponding to the relationship between a sound signal output from the speaker array and the virtual sound signal; and a transfer function multiplying unit generating the virtual sound signal at the position, which is separated from the speaker array by the distance calculated by the transition region distance calculating unit, by multiplying the transfer function by a real sound signal which is to be output from the speaker array.

10. The apparatus of claim 9, wherein the transfer function calculating unit comprises:

a signal measuring unit measuring the generated virtual sound signal, which is output from the speaker array, at the position separated from the speaker array by the distance calculated by the transition region distance calculating unit, wherein the transfer function, which corresponds to the relationship between the generated virtual sound signal output from the speaker array and the measured sound signal, is calculated based on the measured signal.

11. The apparatus of claim 9, wherein the transfer function calculating unit comprises a sound pressure calculating unit calculating sound pressure at the position, which is separated from the speaker array by the distance calculated by the transition region distance calculating unit, and calculates the transfer function, which corresponds to the relationship between the sound signal output from the speaker array and a sound signal at the position, based on the calculated sound pressure and using a predetermined numerical analysis method.

12. The apparatus of claim 8, further comprising:

a signal measuring unit measuring the output virtual sound signal;

a determination unit determining whether the near-field effect has been removed from the output virtual sound signal based on the measurement result; and an adjustment unit selectively adjusting the distance based on the determination result.

13. The apparatus of claim 8, further comprising the transition region distance calculating unit further calculating the calculated distance in consideration of the sound signal which is to be output from the speaker array and physical characteristics of the speaker array.

14. A method of compensating for a near-field effect in a speaker array, the method comprising:

calculating a distance between the speaker array and a transition region in which the near-field effect disappears in a sound signal output from the speaker array, the near-field effect being a phenomenon in which a sound radiated from the speaker array comprises a non-uniform radiation pattern;

generating a virtual sound signal that replicates a sound signal formed at a position located the calculated distance away from the speaker array; and outputting the generated virtual sound signal using the speaker array.

* * * * *

UNITED STATES PATENT AND TRADEMARK OFFICE

CERTIFICATE OF CORRECTION

PATENT NO. : 8,538,048 B2
APPLICATION NO. : 12/076432
DATED : September 17, 2013
INVENTOR(S) : Jung-ho Kim et al.

It is certified that error appears in the above-identified patent and that said Letters Patent is hereby corrected as shown below:

In the Claims:

In Column 12, Line 32, In Claim 8, delete "the by" and insert -- by the --, therefor.

Signed and Sealed this
Eighteenth Day of February, 2014

Michelle K. Lee

Michelle K. Lee
*Deputy Director of the United States Patent and Trademark Office*